US006063135A

United States Patent [19]

Berndt et al.

[11] Patent Number: 6,063,135

[45] **Date of Patent: *May 16, 2000**

[54] DRY CLEANING METHOD AND SOLVENT/ DETERGENT MIXTURE

[75] Inventors: Dieter R. Berndt, Incline Village, Nev.; John McLeod Griffiss, San Francisco, Calif.

[73] Assignee: GreenEarth Cleaning LLC, Leawood, Kans.

[ * ] Notice: This patent is subject to a terminal disclaimer.

[21] Appl. No.: 09/304,222

[22] Filed: May 3, 1999

Related U.S. Application Data

[63] Continuation-in-part of application No. 09/115,352, Jul. 14, 1998, Pat. No. 5,942,007, which is a continuation-in-part of application No. 08/918,629, Aug. 22, 1997, Pat. No. 5,865,852.

[51] Int. Cl.[7] ..... D06L 1/02; D06L 1/04

[52] U.S. Cl. ..... 8/142; 8/137; 510/285; 510/286; 510/287; 134/34; 134/32; 134/33; 134/21; 134/19; 134/42; 134/25.1

[58] Field of Search ..... 8/142, 137; 510/285, 510/286, 287; 134/34, 32, 33, 21, 19, 42, 25.1

[56] References Cited

U.S. PATENT DOCUMENTS

| | | | |
|---|---|---|---|
| 2,176,705 | 10/1939 | Derby . | |
| 2,697,075 | 12/1954 | Echols . | |
| 2,941,952 | 6/1960 | Lewis et al. . | |
| 3,123,494 | 3/1964 | Charreau . | |
| 3,630,660 | 12/1971 | Wedler . | |
| 3,910,848 | 10/1975 | Froehlich et al. . | |
| 4,136,045 | 1/1979 | Gault et al. . | |
| 4,306,990 | 12/1981 | Goodman et al. . | |
| 4,324,595 | 4/1982 | Kasprzak . | |
| 4,337,166 | 6/1982 | Hill et al. . | |
| 4,501,682 | 2/1985 | Goodman et al. . | |
| 4,685,930 | 8/1987 | Kasprzak | 8/139.1 |
| 4,708,807 | 11/1987 | Kemerer | 510/287 |
| 4,961,753 | 10/1990 | Donkers et al. . | |

(List continued on next page.)

FOREIGN PATENT DOCUMENTS

| | | |
|---|---|---|
| 103228 | 3/1984 | European Pat. Off. . |
| 0577563 | 1/1994 | European Pat. Off. . |
| 0609456 | 8/1994 | European Pat. Off. . |
| 766725 | 9/1998 | European Pat. Off. . |
| 3739711 | 6/1989 | Germany . |
| 6-327888 | 11/1994 | Japan . |

OTHER PUBLICATIONS

Environmental Protection Agency; Perchloroethylene Dry Cleaning Facilities; General Recommended Operating and Maintenance Practices for Dry Cleaning Equipment, Oct. 1994.

Patent Abstracts of Japan, abstract for JP 6–327888, Nov. 1994.

*Primary Examiner*—Alan Diamond

*Attorney, Agent, or Firm*—Hickmans Stephens Coleman & Hughes, LLP

[57] ABSTRACT

The present invention comprises a dry cleaning system and method, in which dry cleaning machinery is used in conjunction with a specific solvent which is derived from an organic/inorganic hybrid (organo silicone). Such solvent is used in combination with an organic and/or organo-silicone-based detergent which is specifically tailored for working in conjunction with the solvent to afford optimal cleaning. In a preferred embodiment, the method comprises the steps of loading articles into a cleaning basket; agitating the articles in the solvent and detergent composition in which they are immersed; removing most of the solvent and detergent composition; centrifuging the articles; heating the articles and remaining composition and creating vapors, condensing vapors and optionally reducing the pressure to dry the articles, recovering and recycling solvent and removing the articles from the basket after cooling the articles.

25 Claims, 1 Drawing Sheet

U.S. PATENT DOCUMENTS

| | | | |
|---|---|---|---|
| 4,984,318 | 1/1991 | Coindreau-Palau . | |
| 5,219,371 | 6/1993 | Shim et al. . | |
| 5,301,379 | 4/1994 | Schaal . | |
| 5,302,313 | 4/1994 | Asano et al. . | |
| 5,309,587 | 5/1994 | Fierro . | |
| 5,357,771 | 10/1994 | Schaal . | |
| 5,676,705 | 10/1997 | Jureller et al. . | |
| 5,683,977 | 11/1997 | Jureller et al. . | |
| 5,702,535 | 12/1997 | Gray et al. . | |
| 5,789,505 | 8/1998 | Wilkinson et al. . | |
| 5,858,022 | 1/1999 | Romack et al. . | |
| 5,865,852 | 2/1999 | Berndt . | |
| 5,876,461 | 3/1999 | Racette et al. . | |
| 5,883,067 | 3/1999 | Kubo et al. . | |
| 5,888,250 | 3/1999 | Hayday et al. . | |
| 5,942,007 | 8/1999 | Berndt et al. | 8/142 |

DRY CLEANING METHOD AND SOLVENT/ DETERGENT MIXTURE

CROSS-REFERENCE TO RELATED APPLICATIONS

This application is a continuation-in-part of U.S. patent application Ser. No. 09/115,352 filed Jul. 14, 1998 now U.S. Pat. No. 5,942,007, which is in turn a continuation-in-part of U.S. patent application Ser. No. 08/918,629 filed Aug. 22, 1997 now U.S. Pat. No. 5,865,852.

FIELD OF THE INVENTION

This invention is in the general field of dry cleaning of clothing, textiles, fabrics and the like, and is more particularly directed to a method and apparatus for dry cleaning fabrics using a solvent not heretofore used in dry cleaning machines along with a specially selected detergent.

BACKGROUND OF THE INVENTION

Dry cleaning is a major industry throughout the world. In the United States alone, there are more than forty thousand dry cleaners (many of these have multiple locations). The dry cleaning industry is an essential industry in the present economy. Many articles of clothing (and other items) must be dry cleaned in order to remain clean by removal of body fats and oils, and presentable by preventing shrinking and discoloring.

The most widely used dry cleaning solvent until now has been perchloroethylene (PERC). There are numerous disadvantages to PERC including inherent toxicity and odor.

Another problem in this field is that different fabrics require different handling in the presently used systems in order to prevent damage to the fabrics during the dry cleaning process.

Prior art dry cleaning processes include the use of various solvents with appropriate machinery to accomplish the cleaning. As mentioned earlier, the solvent most widely used has been PERC. PERC has the advantage of being an excellent cleaning solvent, but the disadvantage of being a major health and environmental hazard, i.e., it has been linked to numerous forms of cancer and it is very destructive to ground water and aquatic life. In some areas PERC is prohibited due to these disadvantages. Additionally, in the past, other solvents such as petroleum-based solvents and glycol ethers and esters have been tried and used. These various solvents have been used with mixed cleaning results and problematic fabric/textile compatibility as compared to the results obtained with PERC.

The dry cleaning industry has long depended on petroleum-based solvents and the well-known chlorinated hydrocarbons, perchlorethylene and trichlorethylene, for use in the cleaning of fabrics and articles of clothing. Since the 1940's, PERC was praised as being a synthetic compound that is non-flammable and has great degreasing and cleaning qualities ideal for the dry cleaning industry. Beginning in the 1970's, PERC was found to cause liver cancer in animals. This was an alarming discovery, as dry cleaning waste was placed in landfills and dumpsters at that time, from which it leached into soil and ground water.

Environmental Protection Agency regulations gradually were tightened, culminating in a law that took effect in 1996 that required all dry cleaners to have "dry to dry" cycles, meaning that fabrics and articles of clothing go into the machine dry and come out dry. This required "closed loop" systems that can recapture almost all PERC, liquid or vapor.

The process of "cycle" involves placing fabrics or articles of clothing into a specially designed washing machine that can hold 15 to 150 pounds of fabrics or articles of clothing that are visible through a circular window. Prior to being placed into the machine, the fabrics or articles of clothing are checked and treated by local hand spotting for stains. If the fabric is unusual or known to be troublesome, the label is checked to verify that the manufacturer has deemed the item safe for dry cleaning. If not, the stain may be permanent. As an example, a sugar stain may not be seen, but once it is run through the dry cleaning process, it oxidizes and turns brown. If the stain is grease related, water won't help, but PERC will as it solubilizes grease. In fact, the principle reason for dry cleaning certain clothes (which should not be washed in a regular washing machine) is to remove the build up of body oils (known as fatty acids) because they too oxidize and produce rancid nasty smells.

The grease which builds up in the solvent is removed by filter and by distilling the PERC. In other words, the dirty PERC is boiled and vapors are condensed back to a clean liquid. A small amount of detergent, typically 1 to 1.5% by volume of the total mixture, is typically mixed with PERC to help solubilize stains and/or stain residues from pre-spotting.

Before clothes are removed from the machine, the washer becomes a dryer. Hot air is blown through the compartment but, instead of being vented outside, the air stream goes through a condenser that liquefies the PERC vapors and returns them for reuse. After the washing and drying, clothes are steamed and ironed.

The dry cleaning process removes most of the PERC from the clothes, however, a small amount does remain. Different fibers of clothes retain more solvent than others. For example, natural fibers such as cottons, wools and thicker articles such as sleeping bags, down coats and shoulder pads tend to retain more solvent than the lighter articles or synthetic fibers.

Another major problem associated with dry cleaning clothes is the color fastness of the dyes used. PERC is a very aggressive solvent and quite often the dyes used by manufacturers are fugitive within PERC or other dry cleaning solvents. At times the fabric may be labeled dry clean only but the prints or surface dyes are fugitive in solvents leaving the article non-serviceable. When an article is cleaned and has a fugitive dye the article suffers and the other articles will experience redeposit of dye on their surface.

Another problem associated with the dry cleaning of fabrics is the redeposition of water-soluble soils that have been loosened from one fabric or article of clothing, and redeposited onto the same or another fabric or article of clothing being cleaned. Volatile silicone solvents alone, are extremely effective in dissolving fats, oils and other organic soils from garments and keeping them in suspension, but cannot hold water-soluble soils in suspension without the aid of a proper detergent.

The same problems exist for PERC and the hydrocarbons based solvents. Special detergents have been developed to solve the problems of suspension of water-soluble soils in these organic solvents and of the redeposition of these soils from them. Detergents developed for use with PERC are not compatible with volatile silicone solvents.

The only use of a cyclic siloxane composition for cleaning purposes is disclosed in U.S. Pat. No. 4,685,930 to Kasprzak. However, the disclosure therein is for spot cleaning applications only. There is no disclosure of immersing articles into the cyclic siloxane nor is there any suggestion of using the cyclic siloxane in a dry cleaning machine. Moreover, there is no suggestion of subjecting such articles to immersion in cyclic siloxane agitating, spinning, partial vacuum and heating in a continuous process to dry clean articles in a bulk process for removing fats, oils, grease and other soils from a large number of textile articles.

SUMMARY OF THE INVENTION

The present invention comprises a dry cleaning system and method, in which dry cleaning machinery is used in conjunction with a specific solvent which is derived from an inorganic hybrid (organo silicone). Such solvent is used in combination with an organic and/or organo-silicone-based detergent which is specifically tailored for working in conjunction with the solvent to afford optimal cleaning. In a preferred embodiment, the method comprises the steps of loading articles into a cleaning basket; agitating the articles in the solvent and detergent composition in which they are immersed; removing most of the solvent and detergent composition; centrifuging the articles; optionally reducing the pressure to improve drying and removing the articles from the basket after cooling the articles.

In one aspect of the present invention, linear and/or cyclic hydrophobic organics and/or organo-silicone materials are used as a detergent, the molecules of which have been modified by substitution with polar side chains or "hydrophilic fingers," as surfactants which, in various mixtures, form the basis of a desired detergent that is effective in the removal of water soluble soils from fabrics during the dry cleaning process with volatile silicone fluids in machines. The aim of the detergent is to provide hydrophilicity to the hydrophobic silicone fluids. The desired end result is a detergent material composition that enables water-soluble soils removed from fabrics to remain in a suspended or dissolved state in the silicone fluid.

One of the criteria used to determine the ability of a formulation to provide detergency to a volatile silicone fluid is its ability to suspend water soluble foods, such as ketchup, mustard and milk, in the volatile silicone fluid in tight micelles that coalesced into macro-clusters that then precipitated out of solution. Certain detergent compositions, when used in conjunction with a piece of white test cloth, are effective in preventing redeposition on the test cloth.

The preferred detergent compositions is capable of preventing a water soluble food suspended in the volatile silicone fluid from full dispersion in the solvent and maintain it in tightly coalesced micelles surrounded by the clear solvent.

DESCRIPTION OF THE DRAWINGS

The aforementioned advantages of the present invention, as well as additional objects and advantages thereof, will be more fully understood hereinafter as a result of a detailed description of a preferred embodiment when taken in conjunction with the following drawing in which.

DISCLOSURE OF THE INVENTION

Figure 1:
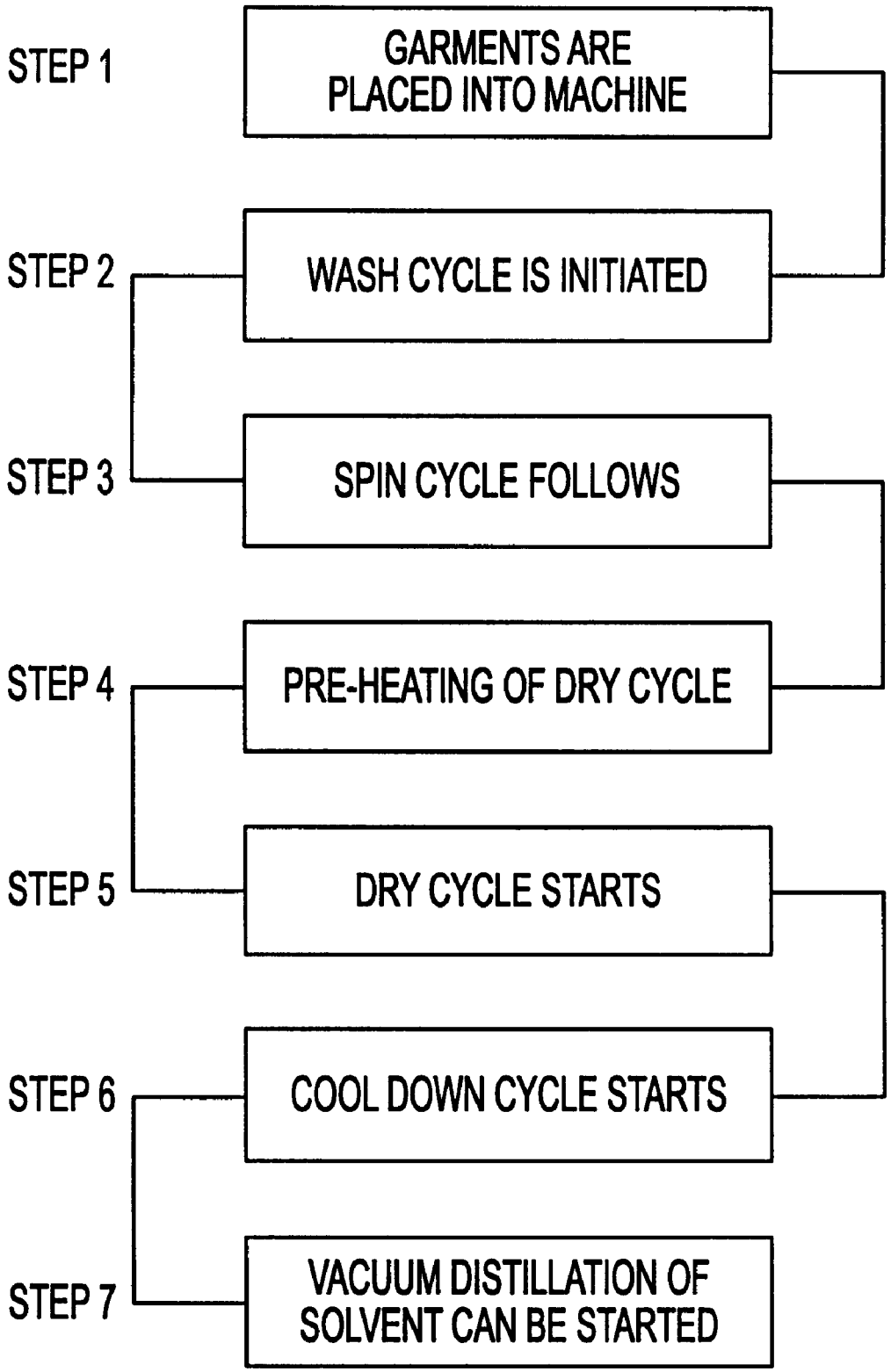
FIG. 1 is a block diagram of the steps of the process showing one embodiment of the present invention.

The present invention includes a method and apparatus for dry cleaning fabrics using a silicone based solvent which has a desirable flash point rating (over 140 degrees Fahrenheit) and fabric-safe qualities (non-dye pulling and non-shrinkage) together with superior solvency for fatty acids, grease and oils in a dry cleaning process.

The present method of dry cleaning employs a fluid class of cyclic siloxanes commonly used for cosmetics and topical pharmaceuticals. These cyclic siloxanes are more particularly known as octamethyl-cyclotetrasiloxane (tetramer), decamethyl-cyclopentasiloxane (pentamer) and dodecamethyl-cyclohexasiloxane (heximer).

The solvent of the present invention is thus environmentally friendly, does not deposit and or build up in clothing, is hypoallergenic, and has unique flammability characteristics. In use, the flashpoint and firepoint of the solution are separated by at least 10 degrees Fahrenheit, whereby the solvent is self extinguishing between the flashpoint and the firepoint Further, the solvent can be heated (over 100 degrees Fahrenheit) without causing harm to fabrics which further improves and speeds up the cleaning process. Finally, the solvent may have a surface tension less than 18 dynes/square centimeter to better penetrate fabric fibers to remove debris to make it easier to remove the solvent from the fabric.

The invention discloses the application of volatile organo silicones as alternative solvents to the common petroleum based aliphatic compounds and the halogenated hydrocarbons. Organosilicones are not found in nature and must be prepared synthetically. The ultimate starting material is sand (silicone dioxide) or other inorganic silicates, which make up 75% of the earth's crust. The organosilicones were first synthesized in 1863 by Firedel and Crafts, who first prepared tetraethyl silane. In the following years, although many other derivatives were synthesized, it was not until the 1940's that widespread interest in organosilicone chemistry emerged.

Silica is a relatively electropositive element that forms polar covalent bonds with carbon and other elements, including the halogens, nitrogen and oxygen. The strength and reactivity of silicone depend on the relative electronegativity of the element to which silicones will be covalently bound. The polysilanes upon controlled hydrolysis readily form the polysiloxanes. These cyclic and linear polymers are commercially known as silicone fluids.

Silicone fluids are non-polar and insoluble in water or the lower alcohols. They are completely miscible in typical aliphatic and aromatic solvents, including the halogenated solvents, but are only partially miscible with the intermediate petroleum fractions such as naphthenes. Silicone fluids are insoluble in the higher hydrocarbons, lube oils, waxes, fatty acids, vegetable oils and animal oils . . . however, the volatile cyclic silicone fluids (tetramer and pentamer) are somewhat soluble in the higher hydrocarbons.

In fact, the lack of dye-pulling and cross staining by the cyclic siloxanes was unexpectedly discovered through the actual reduction to practice of the said cyclic siloxanes as a dry cleaning solvent in a conventional dry cleaning apparatus. The applicants further experienced that the dye pulling problems associated with the conventional solvents were virtually eliminate which resulted in a significant economic gain to the dry cleaning operator. This gain was measured by the ability of the operator to mix garments and articles of clothing, regardless of color, and thus increase cleaning productivity.

As an option, volatile organo silicones (cyclics) may be used in conjunction with an ester additive, more particularly, 2-ethylhexyl acetate (EHA), provide the basis for superior solvency and cleaning ability.

In testing the degreasing ability of the volatile cyclic silicone/EHA mixtures it was found that they performed better than the petroleum-based aliphatic solvents and comparable to the level of PERC. PERC is a very good and aggressive solvent as a degreaser, however, it can be an over-kill for the purpose of normal dry cleaning. The principle purpose of dry cleaning is to pull out the soil and smelly fatty acids which accumulate in a garment or piece of clothing during wear. An ideal dry cleaning solvent should not have the strength to pull dyes, melt plastics and alter the color or texture of the material to be cleaned.

The volatile cyclic silicones in conjunction with certain organic esters, ether and alcohols process many unique physical and chemical qualities which conventional solvents cannot match. The preferred mixture of Decamethylpentacyclosiloxane and 2-Ethyl Hexyl Acetate are unique for many reasons and are truly selective degreasing agents which are chemically inert to the dyed fiber of a fabric no matter if it is a synthetic or natural. This means that the dye is not attacked or pulled from the fiber chemically, as it would be with the present solvents.

The uniform molecular weight of the volatile cyclic silicones and ester combinations give them the desired surface tension that is important for cleaning. Another major point of importance is that the volatile cyclic silicone fluid imparts a "Silky, Soft Hand" to virtually all fabric or textiles. This feature is important because PERC removes the oils of natural fibers and result in a harsh feel or texture.

The cyclic molecular structure makes them much more oxidation resistant than petroleum based materials. This makes distillation of a cyclic silicone much more reliable. The cyclic nature also makes the fluid penetrate the clothing fibers more readily, and releases entrapped soils.

The two main volatile cyclic silicones, namely the tetramer and the pentamer have a wide range in freezing points i.e. the freezing point for the tetramer is 53 degrees Fahrenheit and the freezing point for the pentamer is −40 degrees Fahrenheit . . . nearly 100 degrees Fahrenheit apart. Each of these materials has unique physical properties which by themselves do not make them a viable degreasing solvent for use in a dry cleaning process. For example, the flashpoint of the tetramer is 140 degrees Fahrenheit but its firepoint is 169 degrees Fahrenheit, the flashpoint of the pentamer is 170 to 190 degrees Fahrenheit but its firepoint is 215 degrees Fahrenheit. Both the tetramer and pentanmer can be mixed together to create the desired composition or formula with the right flammability characteristics as well as its freezing point. The preferred ester additive, 2-Ethyl Hexyl Acetate also has a high flashpoint and an extremely low freezing point.

Therefore, the preferred mixture shall be less than 40% EHA and more than 50% pentamer. This range will allow for the development of solvent compositions which are suitable for most dry cleaning operations. Although, the EHA ester is the preferred material, there are numerous materials from the ester, ether and alcohol families, which may exhibit similar capabilities as mentioned earlier. The following is a list of chemicals which can be used as a replacement for EHA in the preferred mixture:

Esters
Dibasic Esters
Glycol Ether DPM Acetate
Clycol Ether EB Acetate
Alcohols
2-Ethylhexyl Alcohol
Cyclohexanol
Hexanol
Ethers
Glycol Ether PTB
Glycol Ether DPTB
Glycol Ether DPNP Although the above represent only a few of the likely additives to the volatile organo cyclic siloxanes, it is the scope of this invention to include those not listed.

It should also be noted that certain additives such as petroleum based derivatives i.e. mineral spirits, halogenated hydrocarbons may be added to the above formulary to attain certain cleaning and/or degreasing results which may not be achievable solely by the above composition.

The following lists various materials compositions relative to the above:

Composition—1:
Tetramer—75% by weight
EHA—25% by weight
Composition—2:
EHA—50% by weight
Pentamer—50% by weight
Composition—3:
EHA—30% by weight
Pentamer—70% by weight
Composition—4:
Tetramer—15% by weight
Pentamer—55% by weight
EHA—30% by weight
Composition—5:
EHA—85% by weight
Pentamer—15% by weight Although the above compositions are mainly based on the volatile organo cyclic siloxanes and EHA, it is within the scope of this invention that the following ranges of composition mixtures are contemplated:

EHA—1% to 99% by weight
Pentamer—1% to 99% by weight
Tetramer—1% to 99% by weight Combinations of the aforementioned solvents or by themselves may be modified and enhanced in one embodiment of the dry cleaning method of the present invention. The modification is in the form of adding soil suspending additives to prevent re-deposition of dirt during the wash and rinse cycle, detergents for water-base stains, brighteners, and disinfectants for the disinfection of bacteria and other forms of microorganisms which are present in all clothing. It should be noted that the additive may be included as a component of the solvent solution or as a separate agent.

A suitable detergent, compatible with the siloxane solvent hereof, is disclosed herein and forms a part of the invention. The detergent comprises an amphipathic molecular configuration having a highly hydrophobic linear or cyclic organosilicone backbone with hydrophilic polar side-chain substitutions and comprising a pure organic molecule or mixed organo-silicone molecule having 1 to 300 moles of polar fingers. Such polar fingers may be ionic. Further, ionic surfactants may be employed in conjunction with the solvent.

The design of a preferred detergent formulation for the volatile silicone solvent should have the following molecular characteristics, in whole or in combination with others:

1. An amphipathic molecular configuration that consists of a highly hydrophobic linear or cyclic backbone with hydrophilic polar side-chain substitutions or "fingers" arrayed from the backbone. The backbone may be a pure organic molecule or a mixed organo-silicone molecule.
2. 1–300 moles of polar fingers per molecule.
3. 20% to 90% by weight of polar fingers.
4. Hydrophile: Lipophile Balance (HLB) of 4 to 18.
5. Where the hydrophilic fingers result from substitutions of the hydrophobic backbone through reactions with ethylene oxide and/or propylene oxide to create polyethers.

Examples of such material compositions that use organo-silicate backbones are:

1. Cyclic Organo-silicone products developed by, and currently available from, General Electric Silicones Division, Waterbury, N.Y. and known by their designated product names as:

SF-1288 (Cyclic Organo-silicone backbone; 66% by weight of ethylene oxide polar fingers)

SF-1528 (Cyclic Organo-silicone backbone; 24% by weight of ethylene oxide and propylene oxide polar fingers; dissolved (10% in 90%) in pentamer).

SF-1328 (Organo-silicone backbone; 24% by-weight of ethylene oxide and propylene oxide polar fingers; dissolved (10% in 90%) in a tetramer and pentamer mixture).

SF-1488 (Organo-silicone backbone; 49% by weight of ethylene oxide polar fingers).

2. Organo-silicone products developed by and currently available from Dow Corning Corp., Midland Mich., and known by their designated product names as: 3225C (Organo-Silicone backbone; ethylene oxide and propylene oxide polar fingers, dissolved in cyclomethicone).

3. A series of linear organic polyethers with ethylene oxide polar fingers developed by Air Products and Chemicals, Inc., Allentown Pa. and known by their designated product names as:

Surfynol 420 (20% by weight, of ethylene oxide polar fingers).

Surfynol 440 (40% by weight, of ethylene oxide polar fingers).

Surfynol 465 (65% by weight, of ethylene oxide polar fingers).

The preferred detergent is an 80:20 combination of GE SF-1528 and Surfynol 440.

The above categorizes the basis of the preferred detergent for use with volatile silicone solvents.

The principal intent of this disclosure is to address the fact that volatile silicone solvents should have added compatible detergents in order to fulfill the required dry cleaning parameters required by the industry.

Preferred detergent compositions are as follows:

1. SF-1328 (50%–90%, by weight), and Surfynol 420 (50%–10%, by weight)
2. SF-1328 (70%–95%, by weight), and Surfynol 440 (30%–5%, by weight)
3. SF-1328 (60%–95%, by weight), and SF-1488 (40%–5%, by weight)
4. SF-1528 (60%–95%, by weight), and Surfynol 420 (40%–5%, by weight)
5. SF-1528 (70%–95%, by weight), and Surfynol 440 (30%–5%, by weight)
6. SF-1528 (60%–95%, by weight), and SF-1488 (40%–5%, by weight)
7. SF-1528 (50%–85%, by weight), Surfynol 440 (49%–5%, by weight), and SF-1288 (1%–10%, by weight)
8. SF-1528 (50%–70%, by weight), Surfynol 440 (49%–5%, by weight), and SF-1488 (1%–25%, by weight)

It should be noted that the above formulations and materials are merely examples of material composition that will achieve the desired objective, in this case a detergent. Any organic and/or organo-silicone-based detergent such as the numerous aforementioned organic and/or inorganic organo-silicone compounds may be used to achieve the desired result along with any other related detergent which is compatible with the volatile silicone dry cleaning solvents as long as it removes water-soluble soils from fabrics and prevent their redeposition during the following dry cleaning process.

The following steps are more specifically describe the dry cleaning method of the preferred embodiment.

At step 1 garments or other items to be dry cleaned are placed in a vertical combination washer dryer with a horizontally rotating agitating cleaning basket (known to those skilled in the art). The barrel of the basket will have numerous holes or perforations, preferably each hole will be ⅛ to ½ inches in diameter. One of the main reasons for these hole sizes, is to take advantage of the low surface tension of this cyclic siloxane to allow the immediate removal of the same during centrifugation.

At step 2 the wash cycle is initiated with the solvent consisting of a combination of the tetramer and pentamer cyclic siloxane. The preferred combination is 80% tetramer and 20% pentamer by weight. In the alternative, the cyclic siloxane solvent may include any of the aforementioned combinations. The additives which modify the above mixture may be added separately just before the washing cycle and need not be part of the solvent composition. The use of these additives, namely detergents and suspending agents, allows the solvent to perform a total garment cleaning process. The solvent and detergent (if used) is pumped from a holding tank into the cleaning basket. The items being cleaned are agitated, such that the mechanical rubbing of the clothes and the penetrating solvent dissolves and loosens dirt, debris and body fats from the fabric fibers, said agitation lasting from 1 to 15 minutes. During the cleaning cycle, the solvent and the detergent mixture (if used) is pumped out of the basket through a "button trap" and then across a filter. The filter system helps to remove the particulate and impurities form the mixture. At times a choice of a "batch" solvent flow may be used wherein the mixture may not be exposed to the filter system, but be pumped from the button trap directly back to the basket. In the alternative, any type of cartridge, discs, flex-tubular, rigid-tubular either individually or in combination. As yet another option, the filtration system further comprises either an additive such as carbon or diatomaceous earth.

At step 3 the items having been cleaned, the mixture is pumped from the basket to the working tank or still and then the articles are centrifuged to remove as much mixture as possible and pump or gravity feed the remaining mixture to its destination. The centrifuging process lasts from 1 to 7 minutes depending on the articles and greater than 350 Revolutions Per Minute (RPM); preferably between 450 to 750 rpm. This operation leaves no more than 2–5%, or typically 3%, solvent residue in the items being cleaned. The higher the rpm, the faster the solvent is removed by the centrifugal force of the spinning basket. The very low surface tension of the solvent maximizes the efficiency of solvent removal via this centrifugal process.

At steps 4 and 5 the garments are tumbled in the basket and heated to a temperature between 110 and 170 degrees Fahrenheit. The temperature is measured as the vapor-laden air exits the cleaning basket at the pre-condensation point. The heating is accomplished by passing pressurized steam through a coil that heats up the air inside the basket through the use of a circulating fan. While this is happening, a partial vacuum can optionally be created inside the machine at negative pressure between 50 and 600 millimeters of mercury (where atmospheric pressure is 760 mm), thereby reducing the vapor points of said composition such that recovery time can be shortened. During this heating cycle, the solvent mixture is vaporized and carried by circulating air to a refrigerated condensing coil that condenses the vapors to a liquid that is collected out of the main air stream. The air stream may then be heated again in a closed loop-type system. In time, typically 10 to 55 minutes, the solvent mixture is removed from the articles and recovered for reuse.

At step 6 the heating cycle is stopped and the cooling cycle begins. The cooling cycle may take between 1 to 10 minutes. The temperature is reduced from a range of 110 to 170 degrees Fahrenheit to below 100 degrees Fahrenheit, preferably in a range between 70–100 degrees Fahrenheit. This is accomplished by eliminating the heat and circulating the air through the refrigerated coils until the process is complete. The air is simply circulated about the heated coil without steam flowing through the coils. The cleaning process is completed when the garments are removed from the machine at the cooled down temperature to reduce secondary wrinkling. Removing the garments at a high temperature would cause wrinkling.

At step 7 the contaminated siloxane solvent is reprocessed and purified through vacuum distillation by way of the liquid ring pump method or the venturi method with additional fan assist. This is accomplished by pumping the solvent with impurities into a vacuum still whose chamber is evacuated to assist the drying process. Heat is generated through steam energized coils in contact with the chamber in the range of 230 to 300 degrees Fahrenheit.

The cyclic siloxanes have boiling points over 150 degrees Fahrenheit. For example, the tetramer has a boiling point over 175 degrees Fahrenheit and the pentamer has a boiling point over 209 Degrees Fahrenheit. To distill these siloxanes at their normal boiling point without vacuum temperatures can assist the cause of chemical destruction, i.e., the ring structure is broken down to a linear structure over 150 degrees Fahrenheit and result in the formation of formaldehyde. In one embodiment of the present invention, it is economically advantageous that provisions be made to purify and recover the contaminated cyclic siloxane which will keep their cyclic ring structure intact, bringing the reprocessed solvent. Vacuum distilling the contaminated cyclic siloxane solvent(s) eliminates the low boiling point contaminates, including residual water, as well as the high boiling point contaminates.

It has been discovered that the cyclic siloxanes, namely, the tetramer and pentamer will azetrope at a low temperature such as 209 degrees Fahrenheit result in pure water and pure solvent with the solvents' contaminated solubles remaining behind as residue.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

What is claimed is:

1. A method of dry cleaning articles comprising the acts of:

(a) immersing said articles to be dry cleaned in a composition including a siloxane solvent and an ionic organo-silicone-based detergent;

(b) agitating said articles in said composition; and (c) removing said composition from said articles.

2. The method recited in claim 1, wherein said composition comprises a siloxane solvent selected from the group consisting of pentamer, tetramer, and hexamer cyclic siloxanes.

3. The method recited in claim 1, wherein said composition further comprises at least one additive selected from the group consisting of disinfectants, surfactants, suspending agents and brighteners.

4. The method recited in claim 1, wherein said organo-silicone-based detergent comprises a backbone with between 1 and 300 moles of polar fingers per molecule.

5. The method recited in claim 1, wherein said organo-silicone-based detergent comprises a backbone with polar fingers between 20% and 90% by weight.

6. The method recited in claim 1, wherein said organo-silicone-based detergent comprises a backbone with a hydrophilic/lipophilic balance of between 4 and 18.

7. The method recited in claim 1, wherein said organo-silicone-based detergent comprises a backbone with ethylene oxide polyether polar fingers.

8. The method recited in claim 1, wherein said organo-silicone-based detergent comprises a backbone with ethylene oxide and propylene oxide polyether polar fingers.

9. The method recited in claim 1, wherein said organo-silicone-based detergent comprises a backbone with linear organic polyethers of ethylene oxide as polar fingers.

10. The method recited in claim 8, wherein said fingers are ionic.

11. The method recited in claim 2, wherein said organo-silicone-based organic based detergent comprises a backbone with between 1 and 300 moles of polar fingers per molecule.

12. The method recited in claim 2, wherein said organo-silicone-based detergent comprises a backbone with polar fingers between 20% and 90% by weight.

13. The method recited in claim 2, wherein said organo-silicone-based detergent comprises a backbone with a hydrophilic/lipophilic balance of between 4 and 18.

14. The method recited in claim 2, wherein said organo-silicone-based detergent comprises a backbone with ethylene oxide polyether polar fingers.

15. The method recited in claim 2, wherein said organo-silicone-based detergent comprises a backbone with ethylene oxide and propylene oxide polyether polar fingers.

16. A method of dry cleaning articles comprising the acts of:

(a) immersing said articles to be dry cleaned in a composition including a siloxane solvent and an ionic organo-silicone-based detergent capable of providing the composition with hydrophilicity such that impurities removed from said articles remain in at least one of a suspended and dissolved state in the composition;

(b) agitating said articles in said composition; and (c) removing said composition from said articles.

17. The method recited in claim 16, wherein said composition comprises a siloxane solvent selected from the group consisting of pentamer, tetramer, and hexamer cyclic siloxanes.

18. The method recited in claim 16, wherein said composition further comprises at least one additive selected from the group consisting of disinfectants, surfactants, suspending agents and brighteners.

19. The method recited in claim 16, wherein said organo-silicone-based detergent comprises a backbone with between 1 and 300 moles of polar fingers per molecule.

20. The method recited in claim 16, wherein said organosilicone-based detergent comprises a backbone with polar fingers between 20% and 90% by weight.

21. The method recited in claim 16, wherein said organosilicone-based detergent comprises a backbone with a hydrophilic/lipophilic balance of between 4 and 18.

22. The method recited in claim 16, wherein said organosilicone-based detergent comprises a backbone with ethylene oxide polyether polar fingers.

23. The method recited in claim 16, wherein said organosilicone-based detergent comprises a backbone with ethylene oxide and propylene oxide polyether polar fingers.

24. The method recited in claim 16, wherein said organosilicone-based detergent comprises a backbone with linear organic polyethers of ethylene oxide as polar fingers.

25. The method recited in claim 19, wherein said fingers are ionic.

* * * * *